United States Patent [19]

Fricker

[11] Patent Number: 4,947,613

[45] Date of Patent: Aug. 14, 1990

[54] RETAINING DEVICE

[76] Inventor: Siegfried Fricker, Wurmberger Strasse 30-34, 7135 Wiernsheim, Fed. Rep. of Germany

[21] Appl. No.: 366,685

[22] Filed: Jun. 15, 1989

Related U.S. Application Data

[62] Division of Ser. No. 143,422, Jan. 13, 1988, Pat. No. 4,869,042.

[30] Foreign Application Priority Data

Jan. 13, 1987 [DE] Fed. Rep. of Germany ..... 3700695

[51] Int. Cl.[5] ..... E04G 21/14

[52] U.S. Cl. ..... 52/704; 52/125.5; 52/125.4

[58] Field of Search ..... 52/125.4, 125.5, 699, 52/706, 704

[56] References Cited

U.S. PATENT DOCUMENTS

| | | | |
|---|---|---|---|
| 875,396 | 12/1907 | White | 52/704 |
| 1,470,727 | 10/1923 | Hall | 52/699 |
| 1,606,289 | 11/1926 | Bowers | 52/706 |
| 2,467,115 | 4/1949 | Duggan | 52/699 |
| 3,431,012 | 3/1969 | Courtois | 52/706 |
| 4,087,947 | 5/1978 | Turner | 52/699 |
| 4,173,856 | 11/1979 | Fricker | 52/699 |
| 4,676,035 | 6/1987 | GangaRao | 52/125.5 |

*Primary Examiner*—Henry E. Raduazo

*Attorney, Agent, or Firm*—Foley & Lardner, Schwartz, Jeffery, Schwaab, Mack, Blumenthal & Evans

[57] ABSTRACT

A retaining device for casting into concrete or the like, particularly concrete slabs, comprised of an anchoring foot and a transport stay. At least one tongue and groove connection is provided between the anchoring foot and stay for a simple and secure fastening of the transport stay to the anchoring foot.

8 Claims, 3 Drawing Sheets

RETAINING DEVICE

This application is a division, of application Ser. No. 07/143,422, filed Jan. 13, 1988, now U.S. Pat. No. 4,869,042.

BACKGROUND OF THE INVENTION

The invention relates to a retaining device which can be cast into concrete, for example, concrete slabs, to facilitate handling and transport of the slab.

In the manufacture of concrete slabs and similar components it is known to cast in retaining devices which comprise an anchoring foot produced from plastic and a transport stay consisting of metal. At the time of assembly the transport stay is plugged into the anchoring foot and secured by a bolt so that the transport stay is aligned perpendicular to the anchoring foot and cannot tilt. The anchoring foot supporting the transport stay is placed upon a formwork base prior to concreting. A retaining device of this type is disadvantageous inasmuch as the plastic anchoring foot has to be of comparatively high-webbed construction for adequate stabilization and absorption of forces, and casting-in or casting-round of concrete is obstructed and inadequate. It is difficult if not impossible to ensure satisfactory embedding of the retaining device in the concrete slab without additional manipulation. A further disadvantage lies in the fact that an additional bolt has to be held in readiness for the attachment of the transport stay in the anchoring foot. Such bolt, as a loose component, can easily be lost on the building site.

SUMMARY OF THE INVENTION

The object of the invention is to provide a retaining device which can be cast into concrete and which comprises a novel anchoring foot and transport stay. A reliable attachment is provided which is simple in construction and quick and easy to utilize, and which overcomes the disadvantages of prior art devices as described above.

Structural details and advantages of the invention will be apparent from the following description and the application drawings.

BRIEF DESCRIPTION OF THE APPLICATION DRAWINGS

DETAILED DESCRIPTION OF THE PREFERRED EMBODIMENTS

The retaining device according to the invention and generally indicated at 1 is intended for casting into concrete or the like, particularly concrete slabs. The device comprises a transport stay 2 and an anchoring foot 3, which can be stood up on the formwork base or attached to a formwork wall before the concrete is cast in.

Figure 1:
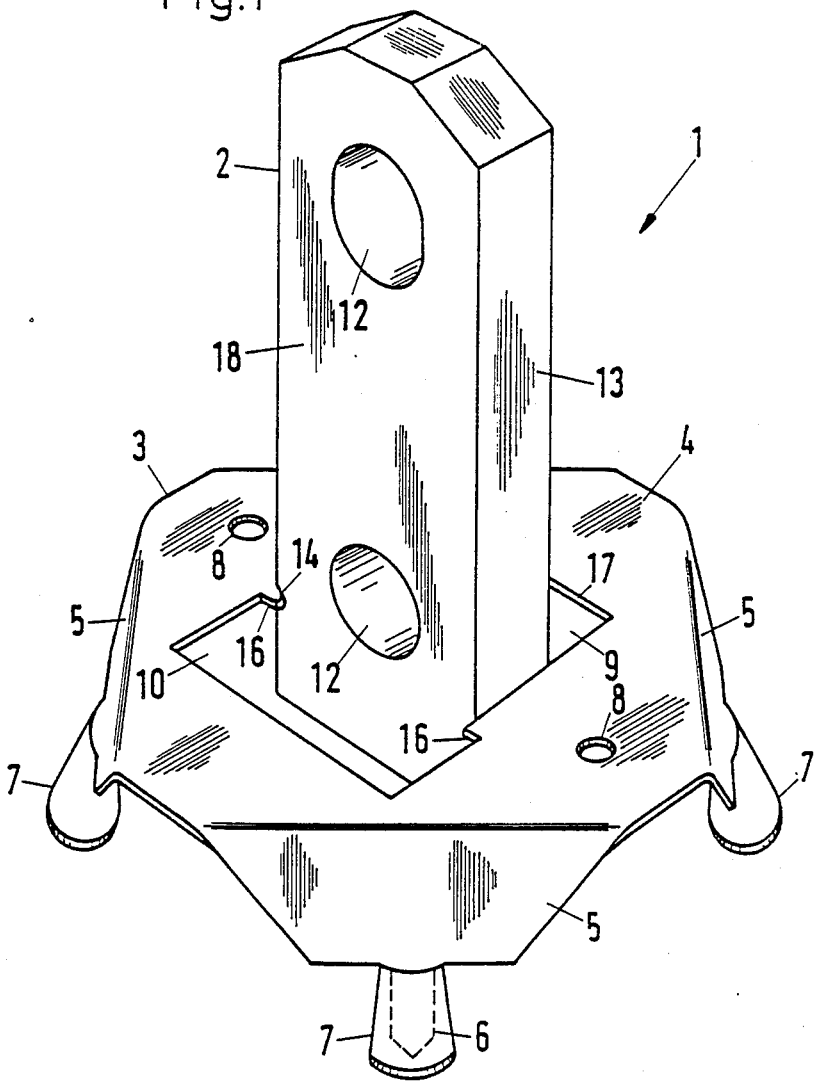
FIG. 1 is a perspective view of the retaining device according to the invention having an anchoring foot produced from a sheet metal blank and a transport stay attached thereto.
Figure 2:
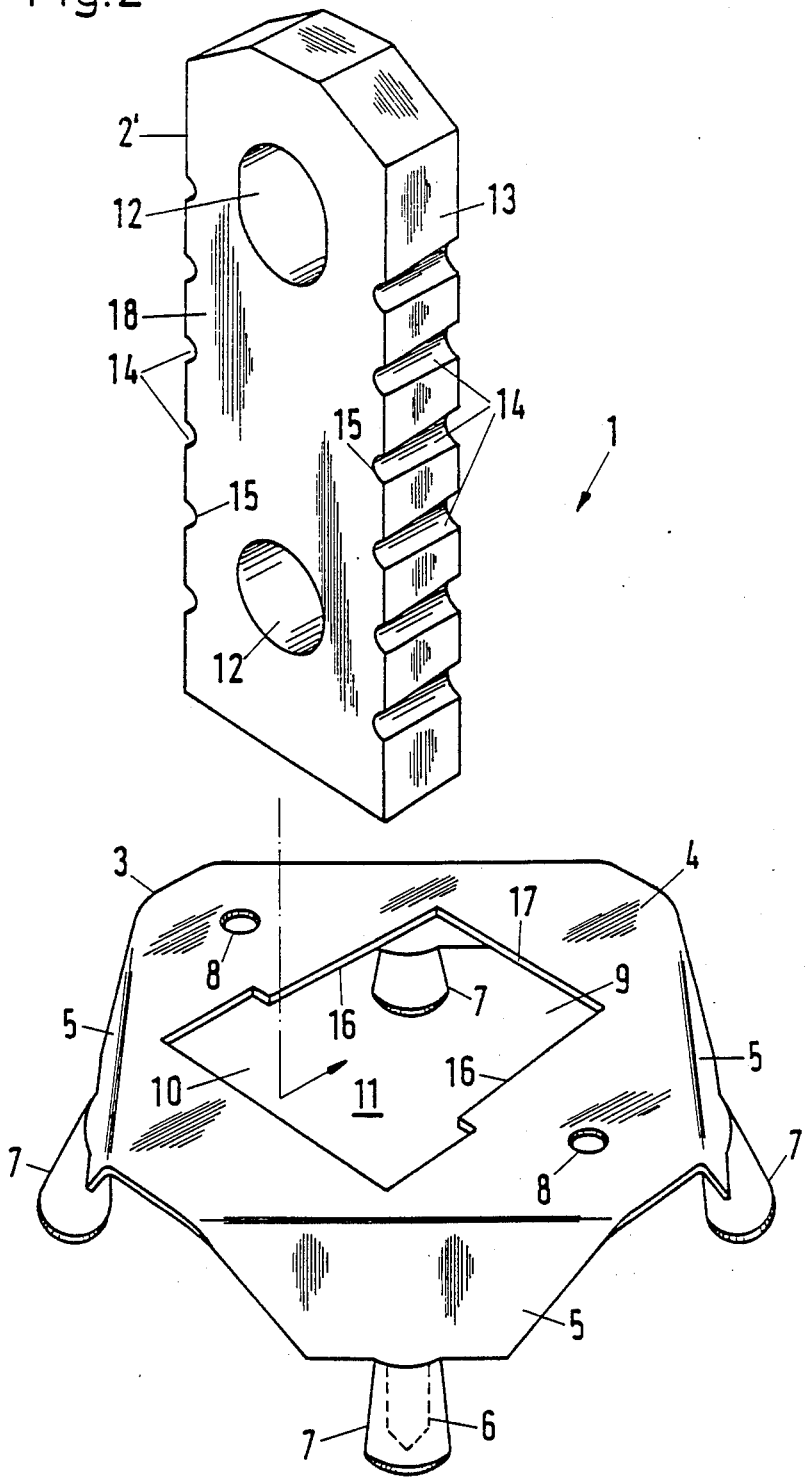
FIG. 2 is an exploded view of a modified retaining device similar in many respects to the device of FIG. 1, but wherein the transport stay is vertically adjustable.

The anchoring foot 3 illustrated in FIGS. 1 and 2 may advantageously consist of a one-part flat sheet metal blank, which is preferably approximately one to two millimeters thick, and which is brought into the illustrated form by a punch-bending process which forms no part of the present invention. During the bending process, the corner regions of the sheet metal blank, which can be generally triangular, rectangular or preferably square, are bent approximately at right angles, thus forming a base plate 4 having lateral walls 5 which extend downwardly from the base plate 4, in the FIG. 1 orientation. The downward pointing corner portions of the lateral walls 5 may be punch-bent outwardly at the sides so as to form narrow pointed webs 6 which constitute legs for the device. Plastic caps 7 may be fitted over these pointed legs 6, so that protection against injury and reliable standing on the formwork base is ensured So that the anchoring foot 3 may also be fastened to uneven and/or nonhorizontal formwork walls, holes 8 are made in the base plate 4, through which the anchoring foot 3 can be attached immovably to the formwork wall by means of nails, wire, screws or similar fastening components.

A recess 9 is formed in the base plate 4 and includes (see FIG. 2) a relatively enlarged plug-in aperture portion 10 and an adjoining narrower push-in aperture portion 11. The length and width of the plug-in aperture 10 is greater than the cross-sectional dimension of the transport stay 2 so as to accommodate the stay prior to interconnecting the components.

The transport stay 2 may be formed from steel, and as shown is rectangular in cross-section. Although the cross-sectional dimensions can vary, a dimension of approximately forty by fifteen millimeters is satisfactory. The stay is formed with perforations 12 which may conveniently be in the form of slots and/or circles by means of which the stay can be engaged for lifting the slab. The stay also has at least one groove 14 formed in each of the opposite sides 13 thereof. The or each groove 14 has a rounded groove bottom 15 (see FIG. 2) and each groove is preferably generally semicircular in cross-section. The distance between mutually opposite groove bottoms in the same plane is generally equal to or somewhat smaller than the distance between the adjacent, opposed edges 16 bounding the recess 9. These edges 16 constitute tongues which extend into the grooves 14 of the transport stay 2 to vertically position and mount the stay on the base plate 4.

It will be seen in FIG. 2 that the portion 11 of the recess 9 is tapered convergingly towards the bottom edge 17 of the recess. That is to say, the width of the portion 11 of the recess at its innermost region (where it merges with the plug-in aperture 10) is greater than the width of the portion 11 where it terminates at the bottom edge 17. FIG. 2 further shows clearly that the groove or grooves 14 in the transport stay 2 or 2' may follow a similar tapered course. As shown, the depth of the groove 14 in the region most adjacent the bottom edge 17 of the recess 9 is greater than the depth of the groove 14 at its opposite end. It is within the ambit of the invention either to taper only the recess 9, or to give only the grooves 14 a tapered course. It is also possible to taper the aperture portion of the recess 9 only on one side edge, or to taper the groove 14 only on one side face 13 of the transport stay 2.

The FIG. 2 embodiment of transport stay 2' is formed with a plurality of grooves 14 in each side face 13, there being six grooves illustrated in each face. Opposite grooves are located parallel to each other at a predetermined spacing, so that essentially a tooth system or rack is provided. It is thereby possible to position the transport stay 2' selectively at different heights on the anchoring foot 3, so that the same stay construction can be used for different sizes and thicknesses of concrete slabs.

At the time of assembly the transport stay 2 or 2' is positioned in the plug-in aperture 10 (see arrow in FIG. 2). When the stay is in the preselected vertical position in the case of stay 2' or in its sole position in the case of stay 2, it is pushed in the direction of the arrow (see FIG. 2) through the push-in aperture 11 into the recess 9, the tongues 16 being aligned with and extending into the grooves 14 during such movement. By virtue of the tapered configuration of the tongues 16 and/or grooves 14, the transport stay 2 or 2' becomes firmly clamped upon further pushing into the recess 9 since the tongues 16 firmly abut against the groove bottoms 15. Thus, a firm force fit and satisfactory retention of the transport stay 2 or 2' in the anchoring foot 3 is ensured.

Figure 3:
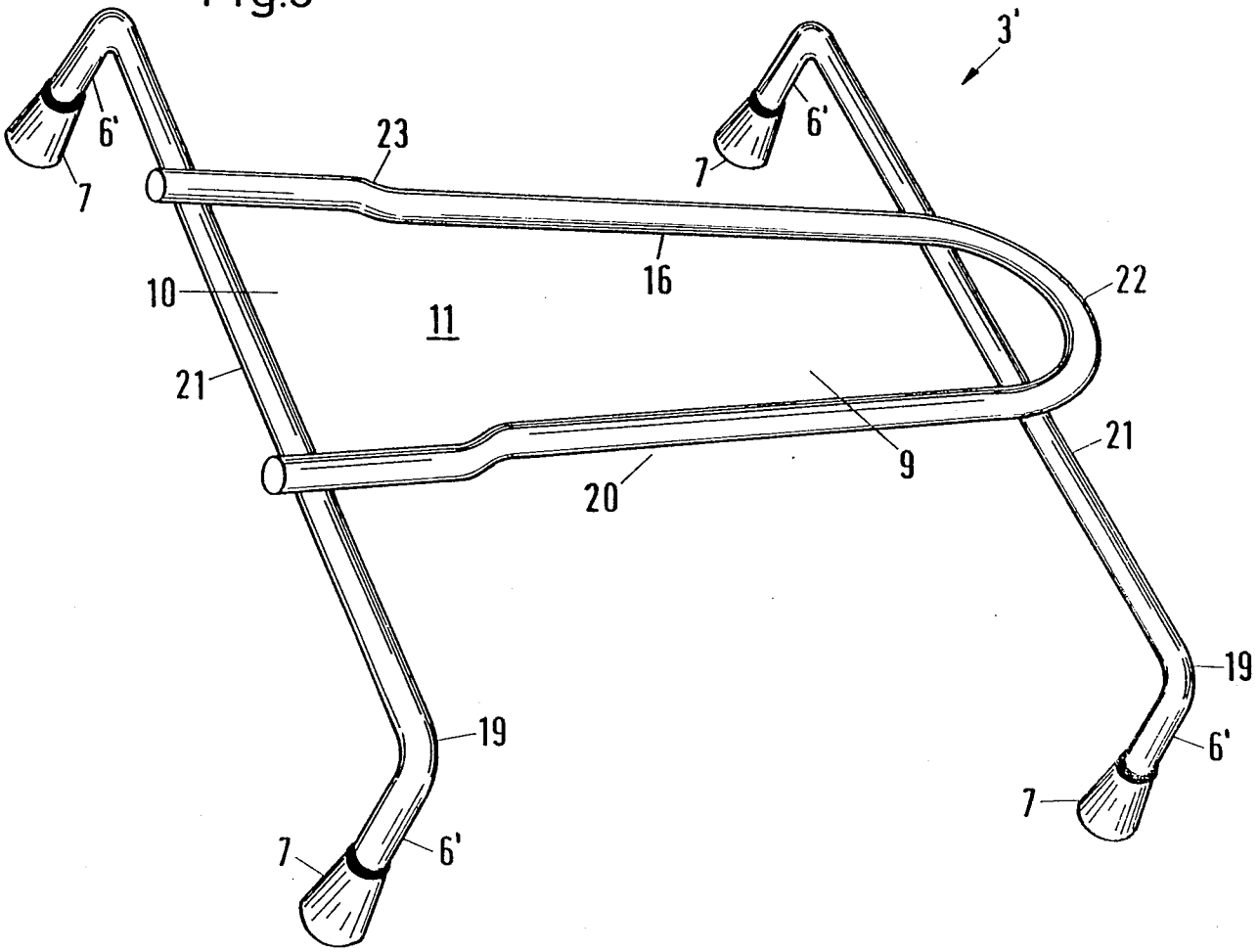
FIG. 3 shows an alternative anchoring foot according to the invention made of bent wire construction.

FIG. 3 illustrates an alternative embodiment of anchoring foot 3' constructed substantially as a bent wire component. The anchoring foot 3, is comprised of two stands 19 formed from wire and a U-shaped wire stirrup 20 fastened to the two stands 19, preferably by welded joints Each stand 19 has a transverse member 21 on which the associated portion of U-shaped wire stirrup 20 is positioned, with the ends of the member 21 being bent approximately at right angles to form legs 6' onto which plastic caps 7 are pushed. It will be seen when comparing the length of the legs 6' of the FIG. 3 embodiment with the vertical dimension of the lateral walls 5 of FIGS. 1 and 2 that the legs 6' are sufficiently long so that the stirrup 20 is positioned high enough on the anchoring foot so as to permit the positioning of the stay in the anchoring foot at different height levels.

The two lateral members or legs 16 of the wire stirrup 20 define the lateral bounds of the recess 9 and are sufficiently resilient in the intermediate portions thereof to effect resilient frictional clamping of the stay. The transport stay 2, 2' (FIGS. 1 and 2) is insertable in the recess and the legs of the stirrup effectively constitute resilient tongues 16 which can engage the grooves 14 of the transport stay 2, 2'. The tongues 16 of the U-shaped wire stirrup 20 gradually converge toward the bottom arcuate portion 22 of the stirrup, thus defining a recess 9 which correspondingly tapers in the same manner. The enlarged aperture 10 is bounded by the free ends of the wire stirrup 20 and by the adjacent transverse member 21. The wire stirrup 20 is bent outwardly as shown at 23, with the bent regions defining the lateral bounds and the entrance area of a reduced width aperture of the recess 9 similar to push-in aperture 11. An essential advantage of the bent wire anchoring foot, in addition to its simple and inexpensive construction, lies in the fact that the tongues 16 of the wire stirrup 20 can move resiliently outwardly when the transport stay 2, 2' is pushed in. Due to the lateral spring return force inherent in the resilient tongues 16, a reinforced force fit is achieved for a satisfactory firm retention of the transport stay 2, 2' in the stirrup.

By virtue of the advantageous configurations of the described anchoring feet 3, 3', large clearances exist for a void-free casting-in or casting-round with concrete, while at the same time the various bent parts in each embodiment extend in different directions, thereby ensuring good anchorage in the concrete. Thus, an absolutely firm retention of the retaining device 1 in the concrete is provided. A further advantage lies in the fact that the anchoring foot 3, having the obliquely angled lateral walls 5 and legs 6, and the anchoring foot 3', having the legs 6', can be stacked closely on top of one another and can therefore be stored and transported with utmost space economy.

The invention is capable of realization irrespective of the cross-section of the stay. It may be circular, oval, angular, rectangular, or square in cross-section as long as it is formed so as to interconnect with and be positively retained by the anchoring foot. A further possible application of the retaining device according to the FIG. 3 embodiment of the invention is that the U-shaped wire stirrup 20, preferably without the two stands 19, can be placed in a simple manner directly upon the reinforcement of a concrete slab, for example, on a steel reinforcing rod or mat, and be fastened on this rod or mat by wires, for example. After this simple fastening of the wire stirrup 20, the stay constructed according to the invention may then be inserted in the manner described into the U-shaped wire stirrup 20 and anchored positively therein, likewise as described. If the transport stay 2 or 2' is in the form of a simple round bolt, for example, the recesses provided for its fastening may be constructed as grooves, as pressed splines, or as a tooth system.

What is claimed:

1. A retaining device which can be cast into concrete, such as concrete slabs, to facilitate handling and transportation of the concrete, comprising:

(a) an anchoring foot adapted to be positioned in association with a concrete form or the like prior to concreting, said anchoring foot comprising a wire stirrup having opposed legs which define a recess and form opposite tongues, said legs being mounted on supporting members in such a manner that said opposite tongues of said stirrup converge toward each other in a direction toward one end of said foot, said tongues being spaced from each other near the end of said foot so as to define a relatively enlarged recess, (b) a separate transport stay adapted to be attached to said anchoring foot, said stay being smaller in width than the width of said enlarged recess and formed with at least one pair of aligned grooves in the sides thereof, said stay being initially positioned in said enlarged recess and then moved in a direction toward the converging opposite tongues which resiliently frictionally engage said grooves to assemble said stay on said foot, (c) said attachment being such that said stay extends away from said anchoring foot and outwardly of the subsequently concreted surface so as to provide means by which the concrete can be handled and transported.

2. The retaining device as claimed in claim 1, wherein said supporting members comprise transverse members formed with supporting legs which are bent generally at right angles to said transverse members.

3. The retaining device as claimed in claim 2, wherein protective caps are positioned on the ends of said supporting legs.

4. The retaining device as claimed in claim 1, wherein said supporting members comprise concrete reinforcing members, said wire stirrup being secured directly to said reinforcing members.

5. The retaining device as claimed in claim 1, wherein two or more spaced grooves are formed in each side of said stay, opposed grooves being aligned so as to form a series of selectively engageable grooves to permit the positioning of the stay on the anchoring foot to be adjusted.

6. The retaining device as claimed in claim 1, wherein said stirrup is a single piece and reversely bent to U-shape, said tongues converging toward the closed end of said stirrup.

7. The retaining device as claimed in claim 1, wherein said opposite tongues are bent laterally outwardly relatively adjacent said other end of said foot so as to define said relatively enlarged recess.

8. The retaining device as claimed in claim 2, wherein said supporting legs are sufficiently long so as to permit the positioning of the stay in the anchoring foot in different height levels.

* * * * *